US008752282B2

(12) United States Patent
Wilson et al.

(10) Patent No.: US 8,752,282 B2
(45) Date of Patent: Jun. 17, 2014

(54) CABLE PREPARATION TOOL

(75) Inventors: Brandon Wilson, Phoenix, AZ (US); Paul Sterkeson, Mesa, AZ (US)

(73) Assignee: PCT International, Inc., Mesa, AZ (US)

( * ) Notice: Subject to any disclaimer, the term of this patent is extended or adjusted under 35 U.S.C. 154(b) by 0 days.

(21) Appl. No.: 13/607,542

(22) Filed: Sep. 7, 2012

(65) Prior Publication Data

US 2013/0086969 A1 Apr. 11, 2013

Related U.S. Application Data

(60) Provisional application No. 61/531,758, filed on Sep. 7, 2011.

(51) Int. Cl.
*H01B 13/00* (2006.01)
*H01R 43/04* (2006.01)

(52) U.S. Cl.
USPC ..... 29/764; 29/828; 140/106; 81/9.41

(58) Field of Classification Search
USPC ..... 29/762, 764, 828; 81/9.41, 9.51; 140/106, 123; 30/90.1, 90.2
See application file for complete search history.

(56) References Cited

U.S. PATENT DOCUMENTS

| | | | | |
|---|---|---|---|---|
| 508,314 | A | 11/1893 | Hill | |
| 1,092,574 | A | 4/1914 | Jannson | |
| 1,164,073 | A | 12/1915 | Cunningham | |
| 1,464,128 | A | 8/1923 | Coes | |
| 1,571,148 | A | 1/1926 | Sisolak | |
| RE16,354 | E | 5/1926 | Carberg | |
| 1,613,976 | A | 1/1927 | Bellows | |
| 1,613,981 | A | 1/1927 | Carlberg | |
| 3,837,244 | A | 9/1974 | Schera, Jr. | |
| 4,215,600 | A | 8/1980 | Kesselman | |
| 4,345,375 | A * | 8/1982 | Hayward | 30/90.1 |
| 4,505,171 | A | 3/1985 | Chang | |
| 4,719,697 | A * | 1/1988 | Schwartzman et al. | 29/867 |
| 4,964,319 | A | 10/1990 | Chang | |

(Continued)

FOREIGN PATENT DOCUMENTS

| | | | |
|---|---|---|---|
| CN | 1701473 | A | 11/2005 |
| CN | 101162821 | A | 4/2008 |

(Continued)

OTHER PUBLICATIONS

Cable Pro, TechToolSupply.com, http://www.techtoolsupply.com/index.asp?PageAction=VIEWPROD&ProdID=223, 2 of 5 pages printed from the Internet on Jun. 8, 2008.

(Continued)

*Primary Examiner* — David B Jones
(74) *Attorney, Agent, or Firm* — Perkins Coie LLP

(57) ABSTRACT

The present disclosure describes various embodiments of devices for preparing cables, such as devices for pulling back the shield on an end portion of a coaxial cable to prepare the end portion for attachment to a connector. A coaxial cable, with an exposed central conductor, a dielectric insulator, and a shield (e.g., a metallic shield) can be inserted into a bore of a shield pull-back device configured in accordance with the present disclosure. As the cable is inserted into the bore, one or more gripping members can engage the cable shield and pull it back evenly without damaging the central conductor or the dielectric insulator.

31 Claims, 6 Drawing Sheets

(56) References Cited

U.S. PATENT DOCUMENTS

| | | | | |
|---|---|---|---|---|
| 5,176,050 | A | 1/1993 | Sauer et al. | |
| 5,179,617 | A | 1/1993 | Stockman | |
| 5,299,474 | A | 4/1994 | Hohmann et al. | |
| 5,301,575 | A | 4/1994 | Mehlau et al. | |
| 5,392,508 | A | 2/1995 | Holliday et al. | |
| 5,415,065 | A | 5/1995 | McMills | |
| 5,487,220 | A | 1/1996 | Saitou | |
| 5,507,211 | A | 4/1996 | Wagner | |
| 5,595,219 | A * | 1/1997 | Deuel et al. | 140/123 |
| 5,615,587 | A | 4/1997 | Foerster, Jr. | |
| 5,743,131 | A | 4/1998 | Holliday et al. | |
| 5,797,300 | A | 8/1998 | Fairbanks | |
| 5,934,137 | A | 8/1999 | Tarpill | |
| 5,941,120 | A | 8/1999 | Jee | |
| 5,983,489 | A | 11/1999 | Jee | |
| 6,186,785 | B1 | 2/2001 | Rogers et al. | |
| 6,196,045 | B1 | 3/2001 | Thomas et al. | |
| 6,293,004 | B1 | 9/2001 | Holliday | |
| 6,349,625 | B1 | 2/2002 | Poganski | |
| 6,427,275 | B1 | 8/2002 | Hung | |
| 6,439,086 | B1 | 8/2002 | Bahr | |
| 6,536,103 | B1 * | 3/2003 | Holland et al. | 29/828 |
| 6,591,487 | B2 | 7/2003 | Chang | |
| 6,606,924 | B2 | 8/2003 | Chandler | |
| 6,637,299 | B1 | 10/2003 | Steele | |
| 6,640,439 | B2 * | 11/2003 | Losinger | 30/90.2 |
| 6,708,396 | B2 | 3/2004 | Holliday | |
| 6,817,272 | B2 | 11/2004 | Holland | |
| 6,848,920 | B2 | 2/2005 | Fox | |
| 6,928,907 | B2 | 8/2005 | Casabonne et al. | |
| 7,011,001 | B2 | 3/2006 | Knox et al. | |
| 7,024,970 | B2 | 4/2006 | Boman | |
| 7,028,393 | B2 | 4/2006 | Wei | |
| 7,032,481 | B2 | 4/2006 | Li et al. | |
| 7,080,581 | B2 | 7/2006 | Reese | |
| 7,096,573 | B2 | 8/2006 | Holliday | |
| 7,120,997 | B2 | 10/2006 | Islam et al. | |
| 7,147,509 | B1 | 12/2006 | Burris et al. | |
| 7,152,309 | B2 | 12/2006 | Liao | |
| 7,222,559 | B2 | 5/2007 | Wang | |
| 7,249,540 | B1 | 7/2007 | Hacker et al. | |
| 7,299,543 | B2 | 11/2007 | Montena | |
| 7,299,725 | B2 | 11/2007 | Helstern et al. | |
| 7,347,129 | B1 | 3/2008 | Youtsey | |
| 7,395,592 | B2 * | 7/2008 | Matsumura | 29/564.8 |
| 7,544,086 | B1 | 6/2009 | Wells | |
| 7,798,849 | B2 | 9/2010 | Montena | |
| 7,975,578 | B2 | 7/2011 | Youtsey | |
| 7,984,553 | B1 * | 7/2011 | Miller et al. | 30/90.1 |
| 8,065,940 | B2 | 11/2011 | Wilson et al. | |
| 8,468,688 | B2 * | 6/2013 | Montena et al. | 29/747 |
| 8,490,525 | B2 | 7/2013 | Wilson et al. | |
| 2002/0174538 | A1 | 11/2002 | Chang | |
| 2002/0194726 | A1 | 12/2002 | Chang | |
| 2003/0051337 | A1 | 3/2003 | Holliday | |
| 2006/0021479 | A1 | 2/2006 | Reese | |
| 2006/0143904 | A1 | 7/2006 | Holliday | |
| 2006/0150784 | A1 | 7/2006 | Hsieh | |
| 2006/0236825 | A1 | 10/2006 | Chiou et al. | |
| 2007/0251085 | A1 | 11/2007 | Holliday et al. | |
| 2008/0087145 | A1 | 4/2008 | Youtsey | |
| 2010/0018040 | A1 | 1/2010 | Bradley | |
| 2010/0022120 | A1 | 1/2010 | Bradley | |
| 2010/0294094 | A1 | 11/2010 | Wilson et al. | |
| 2010/0313412 | A1 | 12/2010 | Youtsey | |
| 2011/0162492 | A1 | 7/2011 | Wilson et al. | |

FOREIGN PATENT DOCUMENTS

| | | |
|---|---|---|
| DE | 202008000753 | 2/1992 |
| EP | 471977 | 2/1992 |
| WO | WO03/056728 | 7/2003 |
| WO | WO2010/135598 | 11/2010 |
| WO | WO2012112580 | 8/2012 |

OTHER PUBLICATIONS

International Search Report and Written Opinion, PCT/US10/35679, Mailed on Sep. 1, 2010, Applicant: PCT International, Inc., 13 pages.

Non-Final Office Action; U.S. Appl. No. 12/470,430; Date of Mailing: Sep. 3, 2010, Applicant: PCT International.

Non-Final Office Action; U.S. Appl. No. 12/484,676; Dated Dec. 7, 2011, Applicant: Timothy L. Youtsey.

Final Office Action mailed Jan. 2, 2014 for U.S. Appl. No. 12/484,676, filed Jun. 15, 2009, 8 pages.

* cited by examiner

CABLE PREPARATION TOOL

CROSS-REFERENCE TO RELATED APPLICATION

The present application claims priority under 35 U.S.C. §119(e) to U.S. Provisional Application No. 61/531,758, filed Sep. 7, 2011, and entitled "CABLE PREPARATION TOOL," which is incorporated herein by reference in its entirety.

TECHNICAL FIELD

The present disclosure relates generally to devices for preparing cables for attachment to connectors, such as devices for preparing coaxial cables for attachment to cable connectors.

BACKGROUND

Electrical cables are used in a wide variety of applications to interconnect devices and carry audio, video, and Internet data. One common type of cable is a radio frequency (RF) coaxial cable ("coaxial cable") which may be used to interconnect televisions, cable set-top boxes, DVD players, satellite receivers, and other electrical devices. Conventional coaxial cable typically consists of a central conductor (usually a copper wire), dielectric insulation, and a metallic shield, all of which are encased in a polyvinyl chloride (PVC) jacket. The central conductor carries transmitted signals while the metallic shield reduces interference and grounds the entire cable. The metallic shield may be a foil wrap around the dielectric insulation, a wire braid, or other suitable shields known in the art. A connector, such as an "F-connector" (e.g., a male F-connector), is typically fitted onto an end of the cable to facilitate attachment to an electrical device.

Before attaching a coaxial cable to a connector, the metallic shield is pulled back and over on itself. Generally, this is performed manually using one's fingers and/or thumbs. If this is not done, a poor connection between the connector and the shield may result, reducing the effectiveness of the shield in attenuating electrical interference. Furthermore, failure to pull back the shield properly may result in contact between the shield and the conductor, potentially causing a short circuit in the cable and/or leading to signal degradation. Pulling back the metallic shield evenly and cleanly in preparation for fitting the connector to the coaxial cable can also help ensure shielding continuity over the entire length of the cable.

SUMMARY

The present disclosure describes various embodiments of tools and associated methods for preparing a cable shield prior to fitment of a corresponding connector.

In one embodiment, a cable end portion is prepared by exposing a short length of a central conductor and removing a portion of jacket to expose a metallic shield. The end portion of the cable is then inserted into a cable shield pull-back device configured in accordance with the present disclosure. As the cable is fed into a bore of the device, a gripping portion engages the shield and pulls the shield back evenly without damaging the central conductor or a surrounding dielectric insulator. The pull-back device is then opened and the cable removed, ready to be fitted to a connector.

Both the foregoing Summary and the following Detailed Description are exemplary only and are not restrictive of the disclosure.

DETAILED DESCRIPTION

Figure 1:
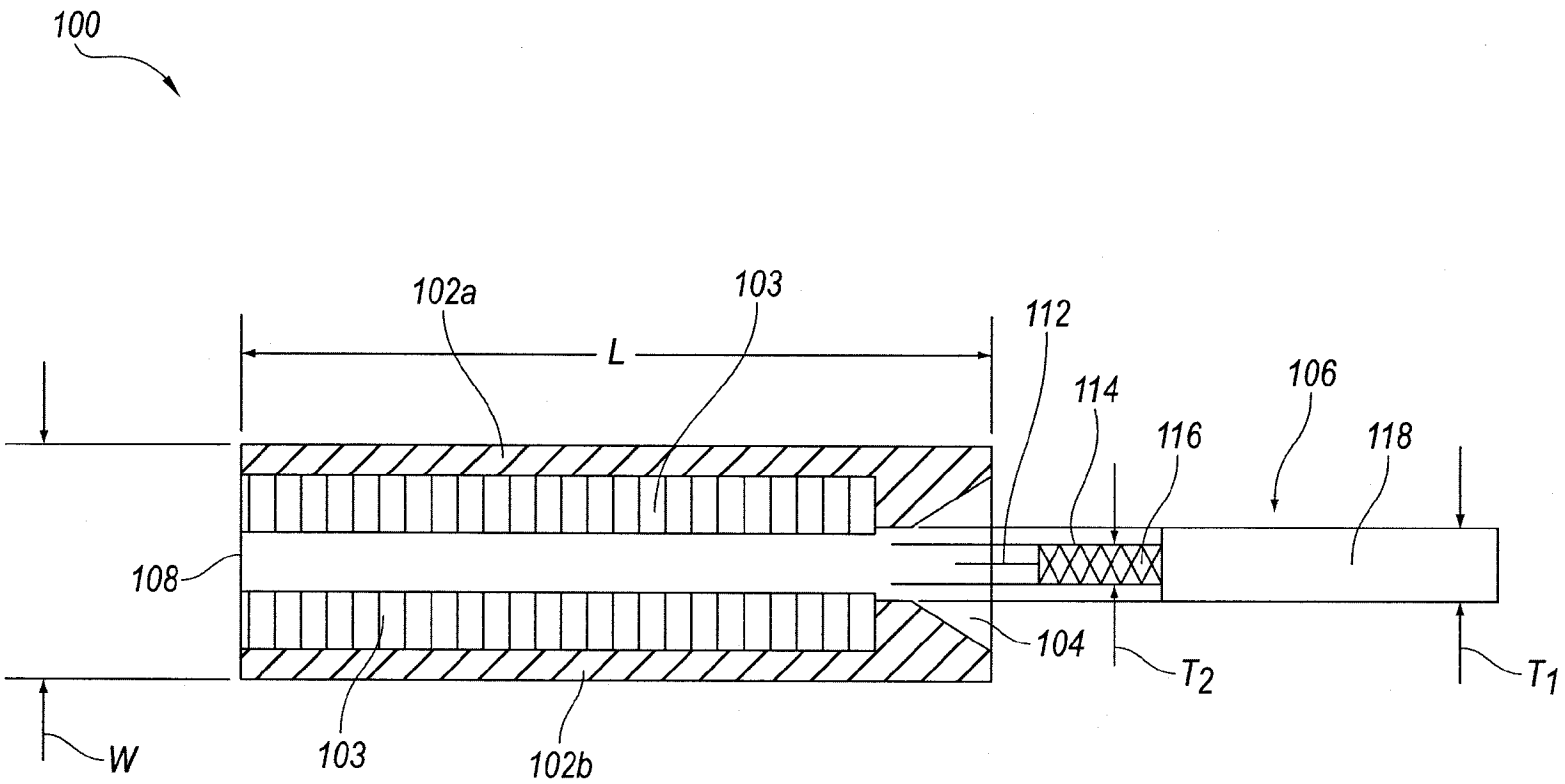
FIG. 1 depicts a partially side, cross-sectional view of an exemplary cable shield pull-back device configured in accordance with an embodiment of the present disclosure.

FIG. 1 is a partially cross-sectional side view of a cable shield pull-back device 100 configured in accordance with an embodiment of the present disclosure. The cable shield pull-back device 100 ("pull-back device 100" or "device 100") can be used to prepare end portions of cables, such as coaxial cables, for attachment to corresponding connectors, such as F-connectors. In the illustrated embodiment, the pull-back device 100 includes a first half or first side portion 102*a* hingedly attached a second side portion 102*b* in a clamshell fashion so that the two side portions 102 can be opened and closed for use. As described in greater detail below, in one embodiment the device 100 further includes a central bore 108 that extends through the length of the device 100. In one aspect of this embodiment, a plurality of gripping members 103 are arranged longitudinally around the bore 108 on interior surfaces of the first and second side portions 102. In some embodiments, the gripping members 103 can be brush members, such as spiral wire brushes, such as gun bore brushes and/or other similar devices.

In operation, a cable 106 (e.g. a coaxial cable) can have a portion of a jacket 118, a shield 116, and an insulator 114 stripped and/or cut away to expose an end portion of a central conductor 112. An adjacent portion of the jacket 118 can also be cut back or otherwise removed to expose a portion of the shield 116 adjacent the exposed portion of the conductor 112. As described in greater detail below, the end portion of the cable 106 can then be inserted into an inlet 104 of the bore 108. The inlet 104 may be tapered or flared to facilitate insertion of the cable 106 into the bore 108. As the cable 106 is pushed further into the bore 108, the gripping members 103 engage the shield 116 and push and/or pull it back over itself.

The device 100 can have various sizes in accordance with the present disclosure depending on the intended application. In one embodiment, for example, the device 100 can have width W (e.g. a diameter) and a length L. The width W can range from about 0.5 inch to about 1.5 inches, such as about 1 inch. The length L can range from about 2 inches to about 4 inches, such as about 3.25 inches. The cable 106 (e.g. a conventional coaxial cable) can have diameter $T_1$ ranging from about 0.25 inch to about 0.5 inch, or about 0.35 inch, and the insulator 114 can have thickness $T_2$ ranging from about 0.1 inch to about 0.25 inch, or about 0.17 inch. In other embodiments, the device 100 and/or the cable 106 can have other lengths and widths that fall outside of the ranges listed above. In the some embodiments, the device 100 can be made of a suitable metal, such as aluminum, steel, etc. In other embodiments, however, the device 100 can be made from other suitable materials, including non-metallic materials such as plastic, epoxy resin, Teflon, or any other suitable material.

Figure 2:
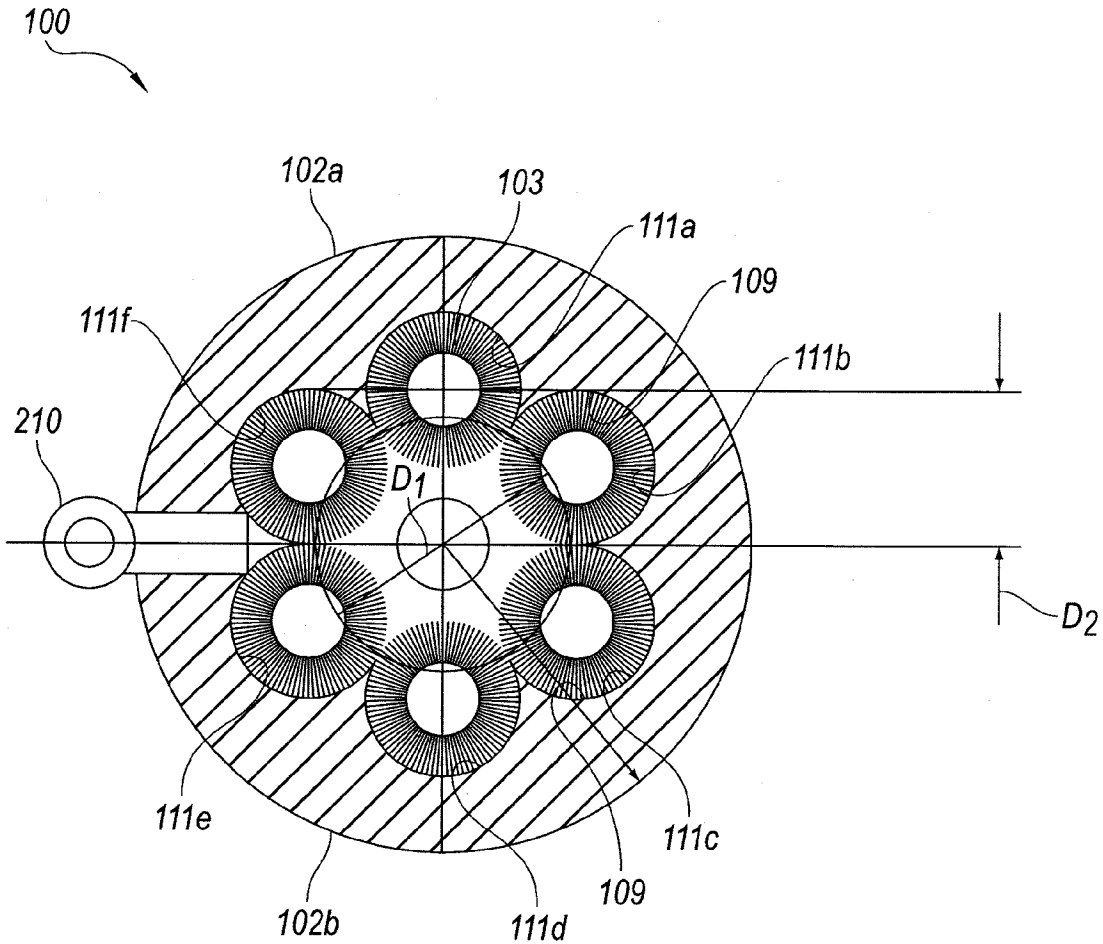
FIG. 2 depicts a cross-sectional end view of the cable shield pull-back device of FIG. 1 in a closed position.

FIG. 2 depicts a cross-sectional end view of the device 100 in the closed position with the first side portion 102*a* mated to or otherwise abutting the second side portion 102*b*. The gripping members 103 are arranged around the circumference of interior surface portion 109 of the bore 108. In the illustrated embodiment, the first side portion 102*a* and the second side portion 102 are pivotally attached by a longitudinal hinge 210. In the closed position, as shown in FIG. 2, the two side portions 102 can generally form a cylinder when joined together. In other embodiments, however, the device 100 may be any suitable shape, such as a rectangle, cube, or sphere.

As previously stated, the device 100 can have various sizes in accordance with the present disclosure depending on the intended application. For example, in one embodiment the bore 108 can have an inner diameter $D_1$ at the inlet 104 (FIG. 1) ranging from about 0.25 inch to about 0.5 inch, or about 0.32 inch. Each of the gripping members 103 can have a diameter $D_2$, which can range from about 0.35 inch to about 0.15, or about 0.25 inch. In other embodiments, these portions of the device 100 may have dimensions that fall outside of the ranges listed above.

Figure 3:
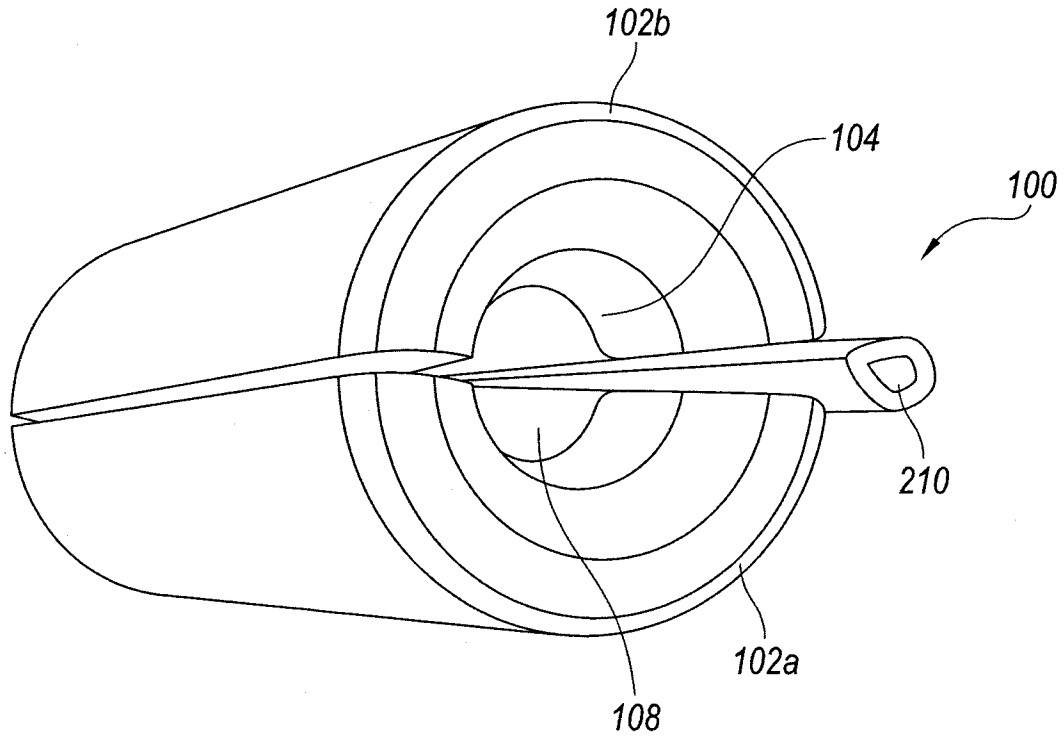
FIG. 3 depicts an isometric view of the cable shield pull-back device of FIG. 1 in the closed position.
Figure 4:
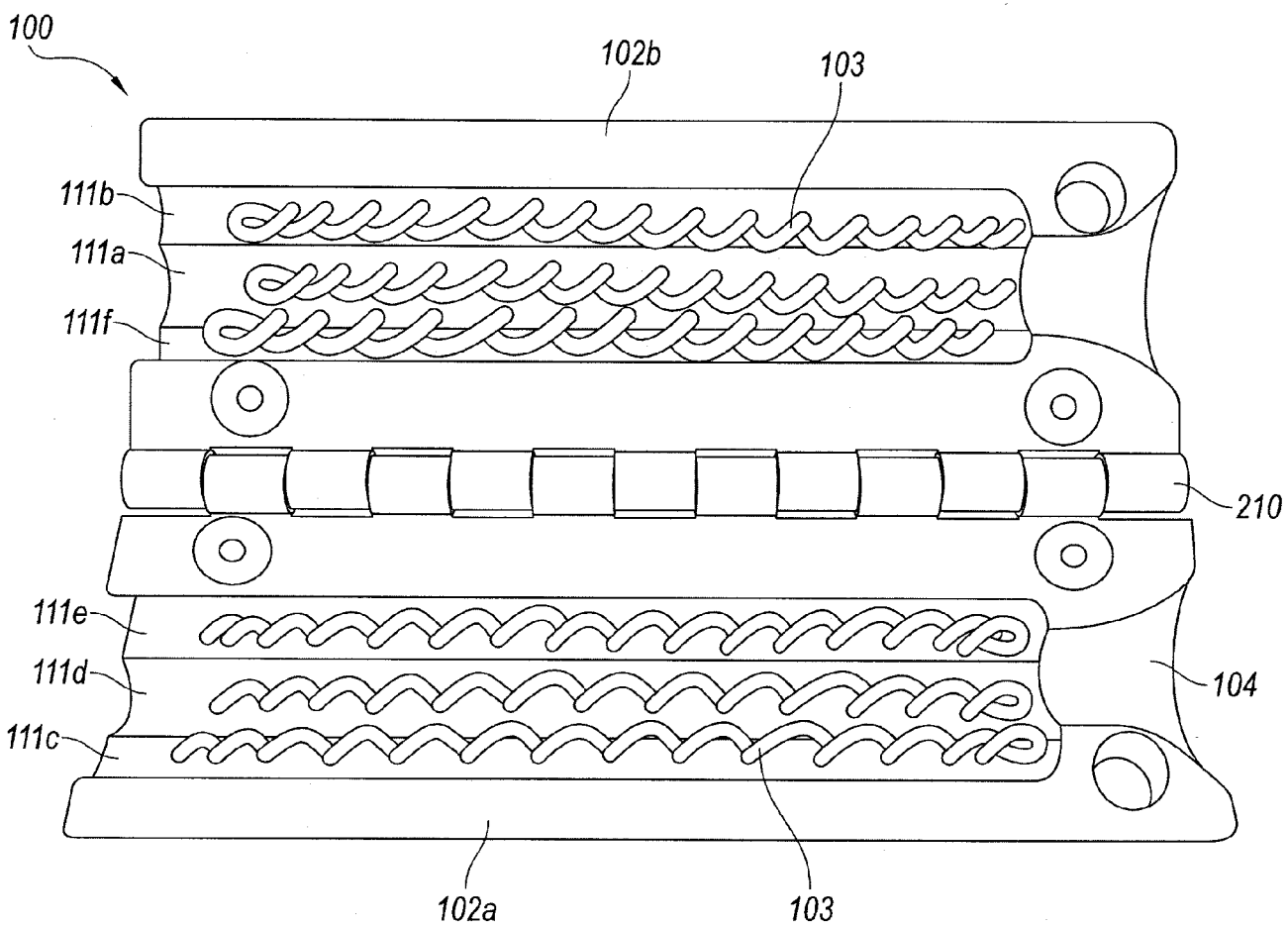
FIG. 4 depicts a side view of the cable shield pull-back device of FIG. 1 in an open position.

FIGS. 3 and 4 are isometric views of the device 100 illustrating various stages of operation. More specifically, FIG. 3 depicts the device 100 in the closed position, similar to FIG. 2, and FIG. 4 depicts the device 100 in the open position, with the gripping members 103 exposed. Referring to FIGS. 2 and 4 together, the interior surface portion 109 of the bore 108 can contain a plurality of grooves or channels, such as troughs 111 (identified individually as troughs 111*a*-111*f*) that are configured to receive and/or retain the gripping members 103 in position around the bore 108. In the illustrated embodiment, the troughs 111 define cylindrical or at least partially cylindrical surfaces. In other embodiments, however, the troughs 111 can have other shapes.

Figure 5:
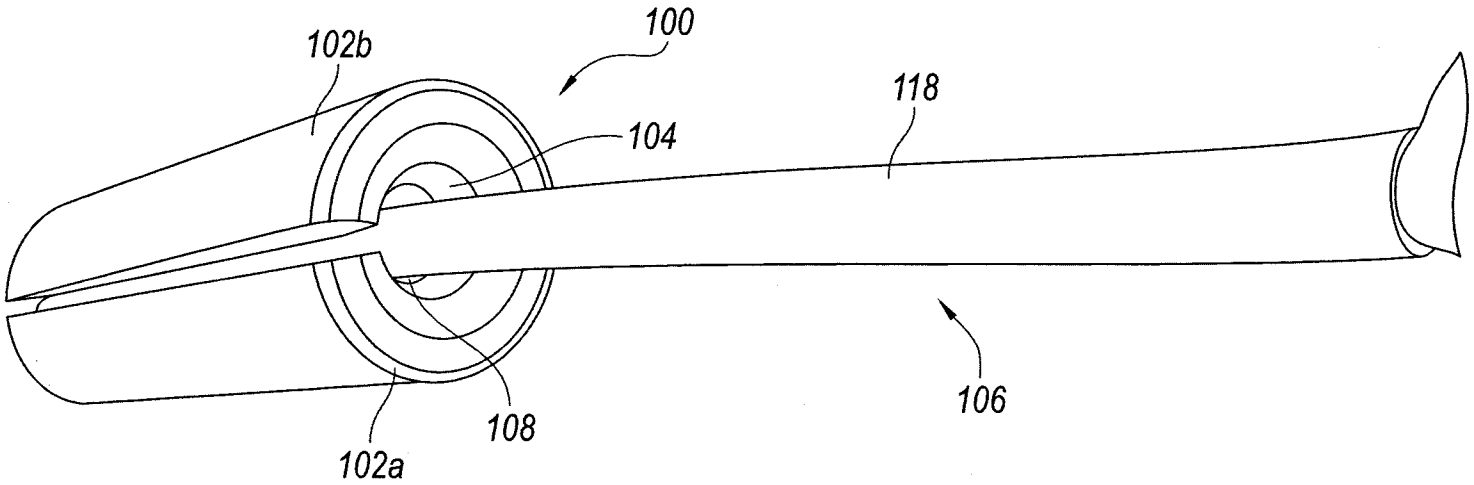
FIG. 5 is an isometric view depicting operation of the cable shield pull-back device of FIG. 1, in accordance with an embodiment of the present disclosure.

FIG. 5 is an isometric view illustrating manual use of the device 100 to prepare an end portion of the cable 106 for attachment to a connector, such as an F-connector (e.g., a "male" F-connector). An operator may hold the closed device 100 in one hand and push or otherwise insert the end portion of cable 106 into the bore 108 with the other hand. The end portion of the cable 106 can be prepared as described above, with an end portion of the central conductor 112 and an adjacent portion of the shield 116 exposed. As the cable 106 is fed through the bore 108, the gripping members 103 engage the shield 116 but not the underlying insulator 114 (FIG. 1). As the cable 106 continues to move through the device 100, the gripping members 103 take hold of the shield 116 and push and/or pull it back over on itself. After the cable 106 has traveled at least a portion of the length of the bore 108 and the shield 116 is sufficiently pushed and/or pulled back, the device 100 may be opened as shown in FIG. 6 below for easy cable removal.

Figure 6:
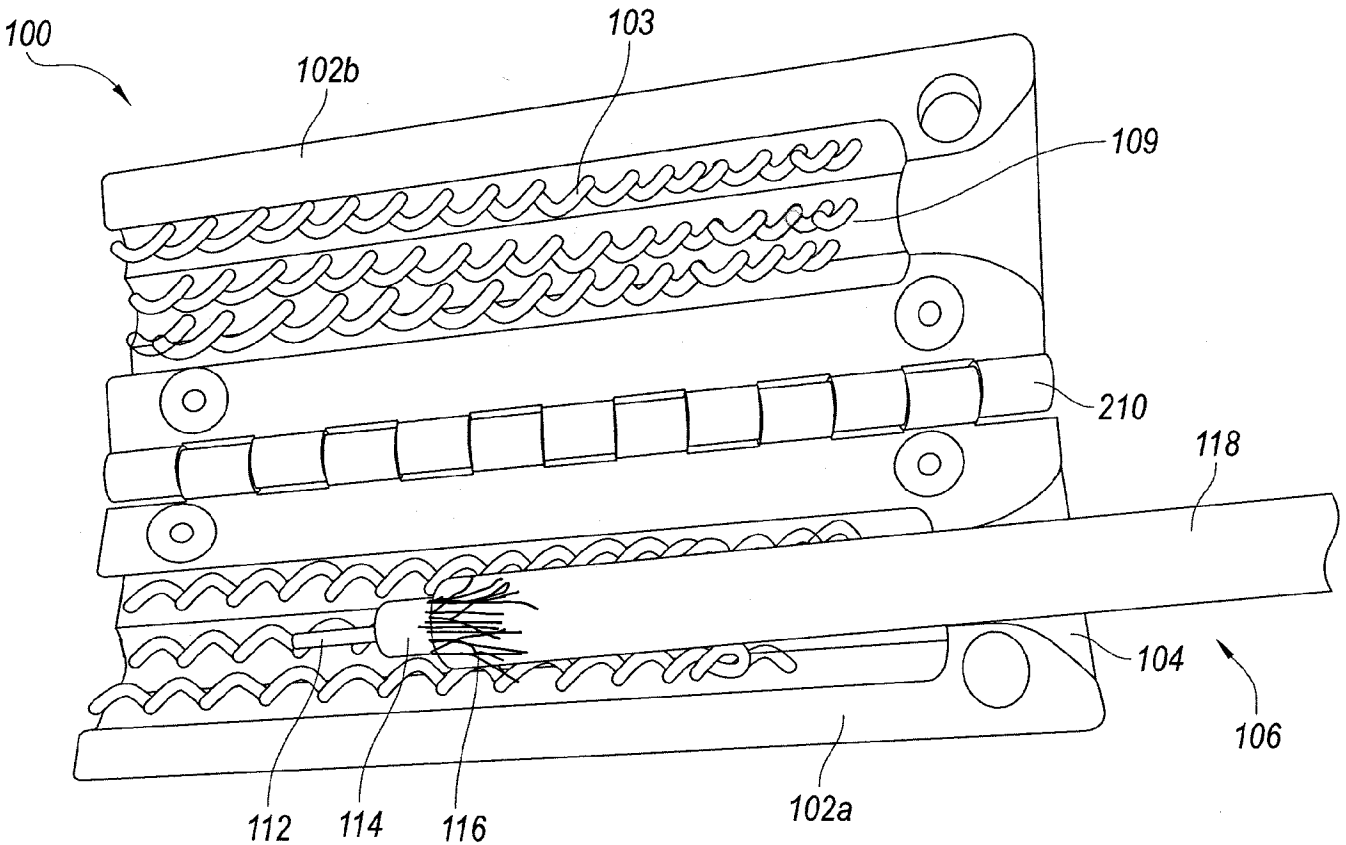
FIG. 6 is a side view depicting another stage of operation of the cable shield pull-back device of FIG. 1, in accordance with an embodiment of the present disclosure.

FIG. 6 is an isometric view of the device 100 in the open position after preparation of the cable 106 therein. As depicted in FIG. 6, the cable 106 has been fed into the device 100, and the shield 116 has been pushed and/or pulled back on itself by the gripping members 103. The cable 106 is now configured so that it can be efficiently attached to, for example, an F-connector, and there is a reduced likelihood of contact between the central conductor 112 and the shield 116 and a greater likelihood shielding continuity throughout the length of the cable 106. The cable 106 in FIG. 6 can be removed from the device 100 in preparation for fitment to a connector.

The particular implementations shown and described above are illustrative of the invention and its best mode and are not intended to limit the scope of the invention in any way. Methods illustrated in the various figures may include more, fewer, or other steps. Additionally, steps may be performed in any suitable order without departing from the scope of the invention. Changes and modifications may be made to the disclosed embodiments without departing from the scope of the present invention. These and other changes or modifications are intended to be included within the scope of the present disclosure, as expressed in the following claims.

The invention claimed is:

1. A cable preparation device comprising:

a body having an internal bore configured to receive an end portion of a cable, wherein the body includes a first body portion pivotally coupled to a second body portion to facilitate access to the internal bore;

a gripping portion disposed on an inner surface of the bore and configured to grip a shield of the cable.

2. The device of claim 1 wherein the first body portion and the second body portion are hingedly attached in a clamshell configuration.

3. The device of claim 1 wherein the bore extends through the entire body.

4. The device of claim 1 wherein the gripping portion includes a brush.

5. The device of claim 1 wherein the gripping portion comprises one or more spiral wire brushes.

6. The device of claim 1 wherein the body includes a plurality of longitudinal troughs circumferentially arranged around the inner surface of the bore, and wherein the troughs retain the gripping portion.

7. The device of claim 1 wherein the gripping portion comprises a plurality of brushes arranged circumferentially in the bore, and wherein each of the brushes includes a plurality of bristles protruding inwardly into the bore.

8. The device of claim 1 wherein the bore includes an inlet, and wherein the inlet is flared to facilitate insertion of the end portion of the cable therethrough.

9. The device of claim 1 wherein the gripping portion is configured to engage the shield and pull the shield back on itself as the end portion of the cable is fed through the bore.

10. The device of claim 1 wherein the gripping portion is configured to engage the shield of the cable without engaging a cable insulator surrounded by the shield.

11. The device of 1 wherein the body includes a plurality of longitudinal troughs circumferentially arranged around the interior surface of the bore, wherein the gripping portion includes a plurality of brushes, and wherein each of the brushes is received and retained in a corresponding one of the troughs.

12. A cable preparation device comprising:

a body having an internal bore configured to receive an end portion of a cable, wherein the body includes a first body portion moveably coupled to a second body portion to facilitate access to the internal bore; and a gripping portion disposed on an inner surface of the bore and configured to grip a shield of the cable, wherein the gripping portion includes a brush.

13. The device of claim 12 wherein the first body portion and the second body portion are hingedly attached in a clamshell configuration.

14. The device of claim 12 wherein the bore extends through the entire body.

15. The device of claim 12 wherein the gripping portion comprises one or more spiral wire brushes.

16. The device of claim 12 wherein the body includes a plurality of longitudinal troughs circumferentially arranged around the inner surface of the bore, and wherein the troughs retain the gripping portion.

17. The device of claim 12 wherein the gripping portion comprises a plurality of brushes arranged circumferentially in the bore, and wherein each of the brushes includes a plurality of bristles protruding inwardly into the bore.

18. The device of claim 12 wherein the bore includes an inlet, and wherein the inlet is flared to facilitate insertion of the end portion of the cable therethrough.

19. The device of claim 12 wherein the end portion of the cable has an outer diameter and the gripping portion defines an inner diameter that is less than the outer diameter.

20. The device of claim 12 wherein the gripping portion is configured to engage the shield and pull the shield back on itself as the end portion of the cable is fed through the bore.

21. The device of claim 12 wherein the gripping portion is configured to engage the shield of the cable without engaging a cable insulator surrounded by the shield.

22. The device of claim 12 wherein the body includes a plurality of longitudinal troughs circumferentially arranged around the interior surface of the bore, wherein the gripping portion includes a plurality of brushes, and wherein each of the brushes is received and retained in a corresponding one of the troughs.

23. A method of preparing a coaxial cable for fitting to a connector, the method comprising:

exposing a metallic shield at an end portion of the cable;

inserting the end portion of the cable into a bore in a body of a device, wherein the bore includes a gripping portion disposed on an inner surface thereof, wherein the gripping portion includes a brush;

pushing the end portion of the cable through the bore while the gripping portion grips the metallic shield of the cable and pushes the metallic shield back over itself;

opening up the body of the device; and removing the end portion of the cable from the device.

24. The method of claim 23 wherein opening up the body includes moving a first body portion relative to a second body portion to expose the bore.

25. The method of claim 24 wherein the first body portion is moveable relative to the second body portion between an open position and a dosed position.

26. The method of claim 23 wherein the gripping portion is configured to grip the metallic shield without engaging a cable insulator surrounded by the metallic shield.

27. The method of claim 23 wherein the pushing comprises holding the body with a first hand and feeding the cable through the bore with a second hand.

28. A method of preparing a coaxial cable for fitting to a connector, the method comprising:

exposing a metallic shield at an end portion of the cable;

inserting the end portion of the cable into a bore in a body of a device, wherein the bore includes a gripping portion disposed on an inner surface thereof, wherein the gripping portion includes a brush;

pushing the end portion of the cable through the bore while the gripping portion grips the metallic shield of the cable and pushes the metallic shield back over itself;

opening up the body of the device, wherein opening up the body includes moving a first body portion relative to a second body portion to expose the bore, and wherein the first body portion is pivotally coupled to the second body portion by a hinge; and removing the end portion of the cable from the device.

29. The method of claim 28 wherein the gripping portion is configured to grip the metallic shield without engaging a cable insulator surrounded by the metallic shield.

30. The method of claim 28 wherein the pushing comprises holding the body with a first hand and feeding the cable through the bore with a second hand.

31. A method of preparing a coaxial cable for fitting to a connector, the method comprising:

exposing a metallic shield at an end portion of the cable;

inserting the end portion of the cable into a bore in a body of a device, wherein the bore includes a gripping portion disposed on an inner surface thereof, wherein the gripping portion comprises one or more spiral wire brushes circumferentially arranged in the bore;

pushing the end portion of the cable through the bore while the gripping portion grips the metallic shield of the cable and pushes the metallic shield back over itself;

opening up the body of the device; and removing the end portion of the cable from the device.

* * * * *

UNITED STATES PATENT AND TRADEMARK OFFICE

CERTIFICATE OF CORRECTION

PATENT NO. : 8,752,282 B2
APPLICATION NO. : 13/607542
DATED : June 17, 2014
INVENTOR(S) : Brandon Wilson et al.

It is certified that error appears in the above-identified patent and that said Letters Patent is hereby corrected as shown below:

In the Claims

In column 4, line 47, in claim 11, delete "of 1" and insert -- of claim 1 --, therefor.

In column 5, line 43, in claim 25, delete "dosed" and insert -- closed --, therefor.

Signed and Sealed this
Third Day of February, 2015

Michelle K. Lee

Michelle K. Lee
*Deputy Director of the United States Patent and Trademark Office*